US009869045B2

(12) United States Patent
Vecchio

(10) Patent No.: US 9,869,045 B2
(45) Date of Patent: Jan. 16, 2018

(54) QUILT DESIGN SUPPORT

(71) Applicant: Anna Maria Vecchio, Peabody, MA (US)

(72) Inventor: Anna Maria Vecchio, Peabody, MA (US)

( * ) Notice: Subject to any disclaimer, the term of this patent is extended or adjusted under 35 U.S.C. 154(b) by 0 days.

(21) Appl. No.: 14/810,520

(22) Filed: Jul. 28, 2015

(65) Prior Publication Data

US 2016/0059620 A1 Mar. 3, 2016

Related U.S. Application Data

(60) Provisional application No. 62/043,583, filed on Aug. 29, 2014.

(51) Int. Cl.

| | |
|---|---|
| ***D05B 91/10*** | (2006.01) |
| ***A47B 97/08*** | (2006.01) |
| ***D05B 97/12*** | (2006.01) |
| ***B44D 3/18*** | (2006.01) |

(52) U.S. Cl.

CPC ..... *D05B 91/10* (2013.01); *A47B 97/08* (2013.01); *B44D 3/18* (2013.01); *B44D 3/185* (2013.01); *D05B 97/12* (2013.01)

(58) Field of Classification Search

CPC ..... B44D 3/18; B44D 3/185; A47B 97/04; A47B 97/08; A47B 23/043; A47F 5/00; A41H 3/00; D06C 3/08; D05B 97/12; D05B 91/10; G09F 7/20

See application file for complete search history.

(56) References Cited

U.S. PATENT DOCUMENTS

| | | | | |
|---|---|---|---|---|
| 926,657 | A * | 6/1909 | Jeresemann et al. | A47B 97/08 248/463 |
| 4,044,980 | A * | 8/1977 | Cummins | A47B 23/043 206/305 |
| 5,290,002 | A * | 3/1994 | Cohen | A47B 23/043 248/456 |
| 5,797,578 | A * | 8/1998 | Graffeo | A47B 23/043 248/453 |
| 6,045,108 | A * | 4/2000 | Cziraky | A47B 97/08 248/454 |
| 6,862,823 | B2 * | 3/2005 | deCarteret | D05B 97/12 38/102 |
| 7,581,343 | B1 * | 9/2009 | Baxter | G09F 17/00 40/603 |

(Continued)

FOREIGN PATENT DOCUMENTS

NL WO 2014119993 A1 * 8/2014

*Primary Examiner* — Ismael Izaguirre
(74) *Attorney, Agent, or Firm* — Dunlap Bennett & Ludwig PLLC

(57) ABSTRACT

A quilt support formed of a rigid plate. The rigid plate includes a front surface and a rear surface. A gripping layer is attached to the front surface of the rigid plate. A foldable stand is pivotally attached to the rear surface of the rigid plate. The foldable stand includes a folded position and a deployed position. The folded position includes the foldable stand pivoted towards and resting against the rear surface. The deployed position includes the foldable stand pivoted away from the rear surface. The foldable stand is operable to support the rigid plate in an upright position when resting on a surface such that the rigid plate is disposed at an angle relative to the surface when in the deployed position.

8 Claims, 4 Drawing Sheets

(56) References Cited

U.S. PATENT DOCUMENTS

| | | | | |
|---|---|---|---|---|
| 7,757,416 | B2 * | 7/2010 | Shearrow | A47G 9/0284 211/87.01 |
| 9,198,507 | B1 * | 12/2015 | Lau | A47B 23/00 |
| 2012/0279097 | A1 * | 11/2012 | Crosse | D05B 91/06 38/102.2 |
| 2013/0014411 | A1 * | 1/2013 | Garcia | D06C 3/08 38/102.1 |

* cited by examiner

QUILT DESIGN SUPPORT

CROSS-REFERENCE TO RELATED APPLICATION

This application claims the benefit of priority of U.S. provisional application No. 62/043,583, filed Aug. 29, 2014, the contents of which are herein incorporated by reference.

BACKGROUND OF THE INVENTION

The present invention relates to quilts and, more particularly, to a quilt design support.

A quilt is a type of blanket, traditionally composed of three layers of fiber: a woven cloth top, a layer of batting or wadding, and a woven back, combined using the technique of quilting. Quilts are distinguished from other types of blanket because they are pieced together from several layers of cloth by stitches or ties. Where a single piece of fabric is used for the top, (a "wholecloth quilt"), the key decorative element is likely to be the pattern of stitching, but where the top is "pieced" from a patchwork of smaller fabric pieces, the pattern and color of the pieces will be important. Quilters often have trouble with accuracy and often times lose small pieces of fabric when piecing their quilt blocks together.

As can be seen, there is a need for a stand that allows quilters to arrange and attach quilt blocks together.

SUMMARY OF THE INVENTION

In one aspect of the present invention, a quilt support comprises: at least one rigid plate comprising a front surface and a rear surface; a gripping layer attached to the front surface of the rigid plate; and a foldable stand pivotally attached to the rear surface of the rigid plate, wherein the foldable stand comprises a folded position wherein the foldable stand is pivoted towards the rear surface and a deployed position wherein the foldable stand is pivoted away from the rear surface, wherein the foldable stand is operable to support the rigid plate in an upright position when resting on a surface such that the rigid plate is disposed at an angle relative to the surface.

These and other features, aspects and advantages of the present invention will become better understood with reference to the following drawings, description and claims.

DETAILED DESCRIPTION OF THE INVENTION

Figure 1:
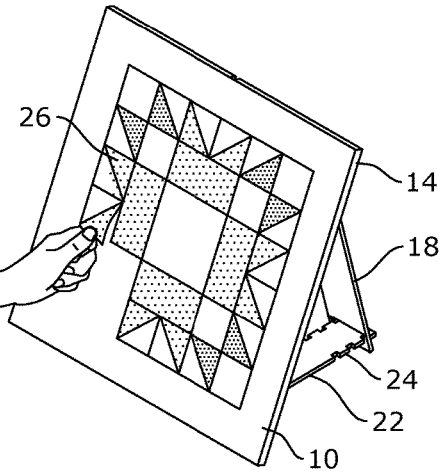
FIG. 1 is a perspective view of an embodiment of the present invention, shown in use.
Figure 2:
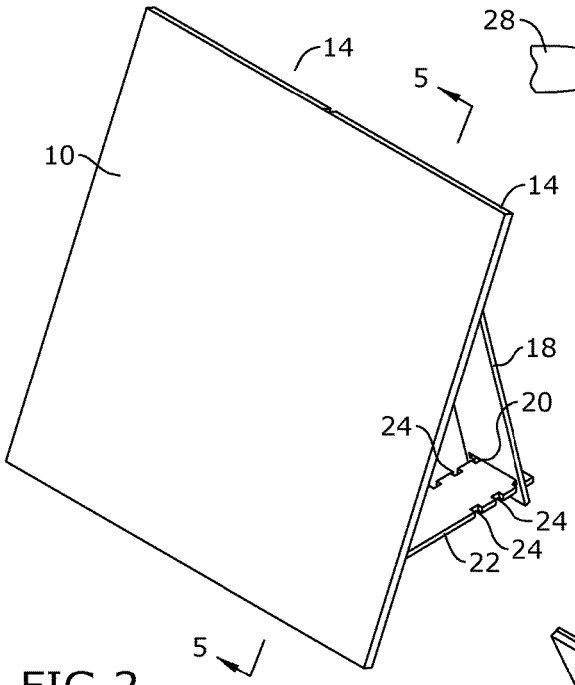
FIG. 2 is a front perspective view of an embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Referring to FIGS. 1 through 10, the present invention includes a quilt support formed of a rigid plate 14. The rigid plate 14 includes a front surface and a rear surface. A gripping layer 10 is attached to the front surface of the rigid plate 14. A foldable stand 18, 22 is pivotally attached to the rear surface of the rigid plate 14. The foldable stand 18, 22 includes a folded position and a deployed position. The folded position includes the foldable stand pivoted towards and resting against the rear surface. The deployed position includes the foldable stand pivoted away from the rear surface. The foldable stand is operable to support the rigid plate 14 in an upright position when resting on a surface such that the rigid plate 14 is disposed at an angle relative to the surface when in the deployed position.

The rigid plate 14 may be made of any rigid material, such as wood, plastic, metal and the like. In certain embodiments, the present invention may include two rigid plates 14 hinged together by a center strap 12. The center strap 12 may be adhered to the first rigid plate 14 and the second rigid plate 14, thereby securing the rigid plates 14 together. The rigid plates 14 may fold about the center strap 12 in the folded position.

The gripping layer 10 of the present invention may be a fabric layer. The fabric layer may be a felt material, a flannel material, or a combination thereof. In certain embodiments, the center strap 12 may be adhered to the front surfaces of the rigid plates 14. The gripping layer 10 may be adhered to the front surfaces of the rigid plates 14 and center strap 12, thereby covering the center strap 12.

The stand 18, 22 may include a first leg 18 and a second leg 22. The first leg 18 is pivotally attached to a top end of the rear surface by a living hinge 16. The second leg 22 pivotally attached to a bottom end of the rear surface by a living hinge 16. The first leg 18 releasably secures to the second leg 22 in the deployed position. For example, the first leg 18 may include a slot 20 having a wide portion and a narrow portion. The second leg 22 includes a plurality of notches 24. The second leg 22 is inserted into the wide portion, and when the notches are within the wide portion, the second leg 22 is lowered into the narrow portion, interlocking the first leg 18 and the second leg 22 together. The second leg 22 may include a plurality of rows of notches. Therefore, the first leg 18 may attach to different lengths of the second leg 22, adjusting the angle of the rigid plate 14 relative second leg 22 and the surface in which the stand 18, 22 is resting.

Figure 3:
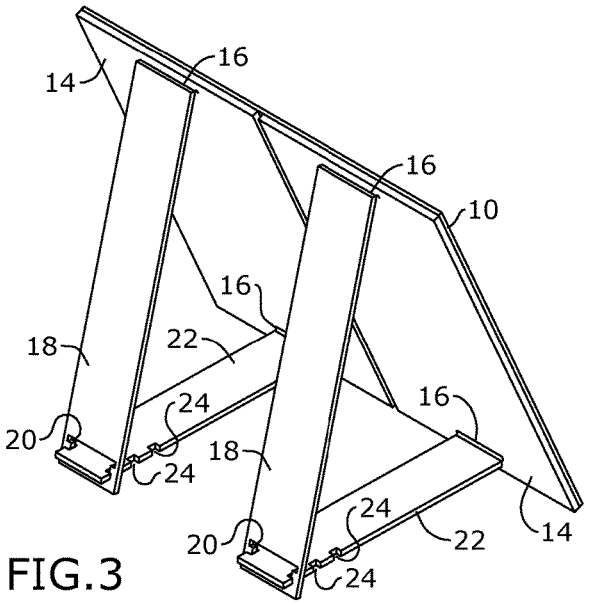
FIG. 3 is a rear perspective view of an embodiment of the present invention.
Figure 4:
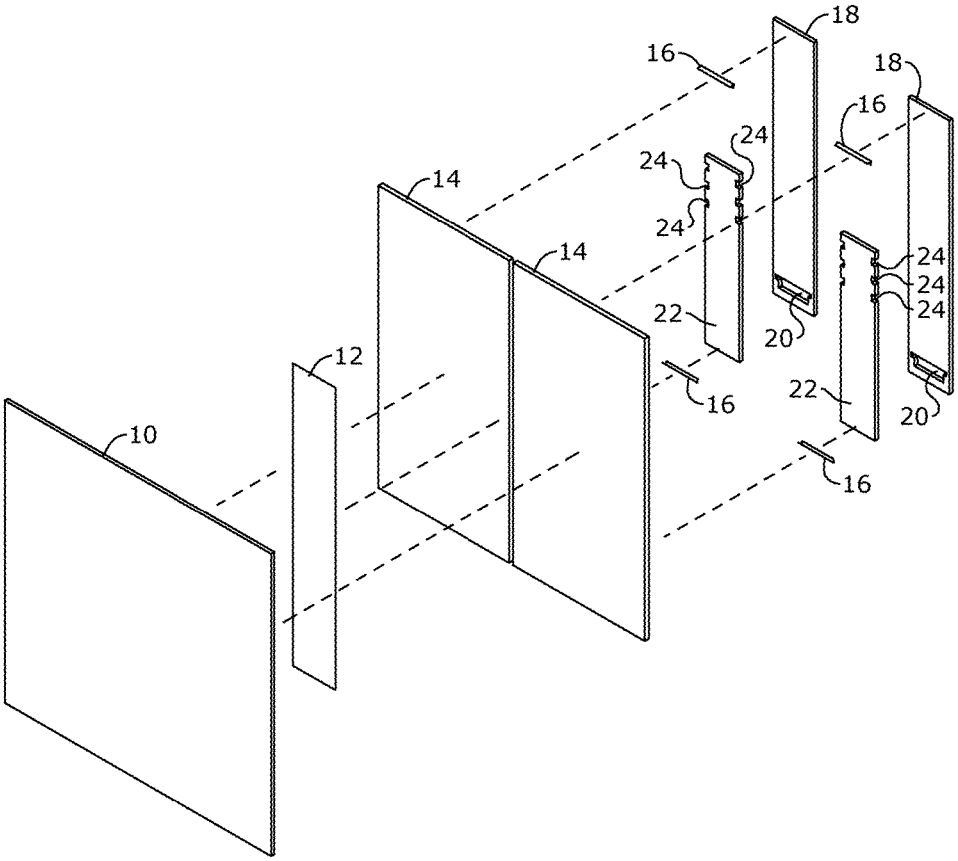
FIG. 4 is an exploded view of an embodiment of the present invention
Figure 5:
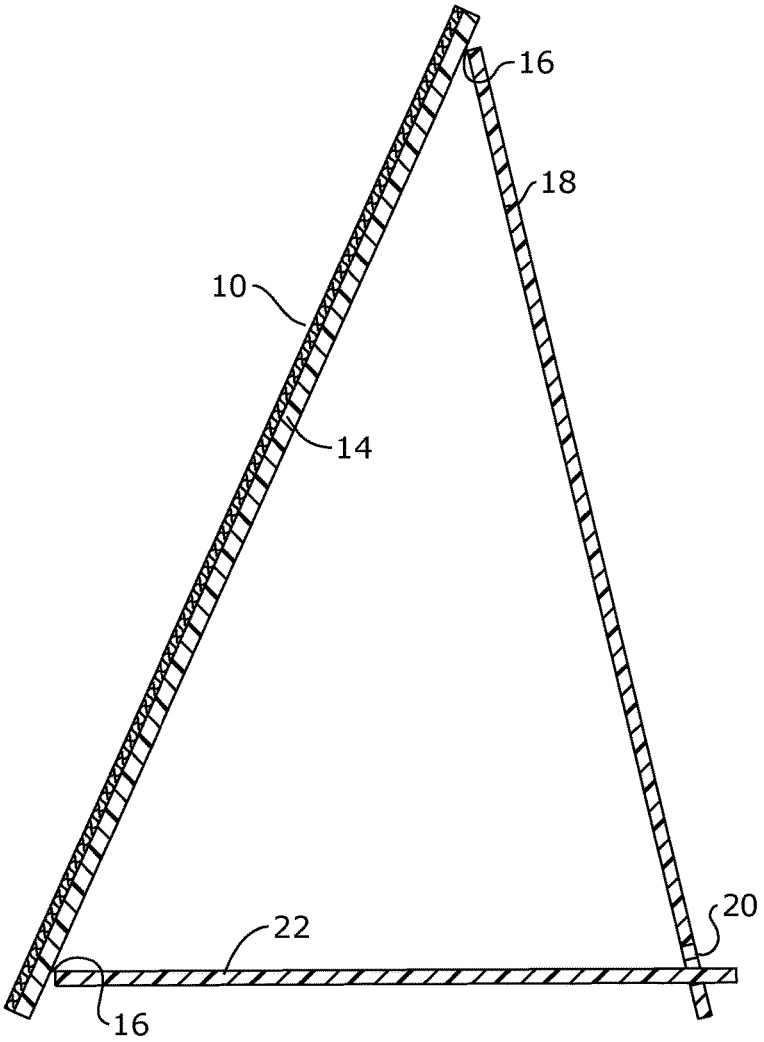
FIG. 5 is a section view taken along line 5-5 in FIG. 2.
Figure 6:
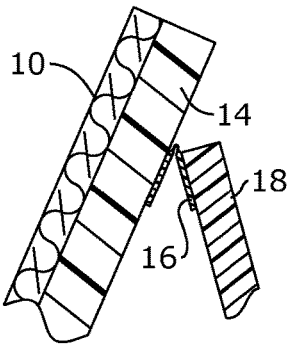
FIG. 6 is a detail section view of an embodiment of the present invention.
Figure 7:
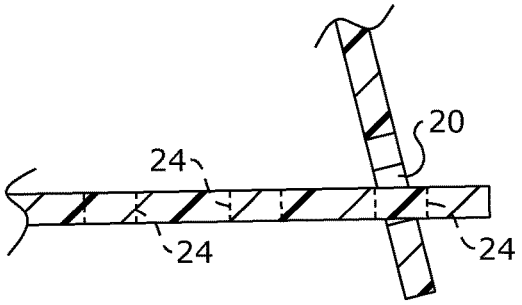
FIG. 7 is a detail section view of an embodiment of the present invention.
Figure 8:
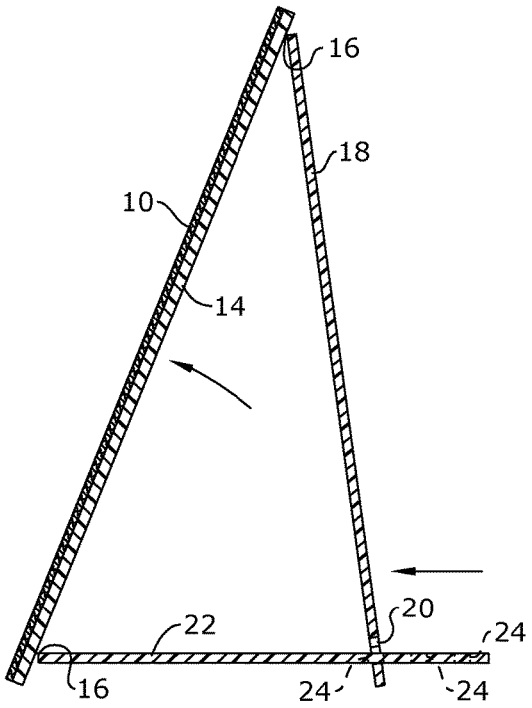
FIG. 8 is a section view of an embodiment of the present invention illustrating the adjustment of the legs.
Figure 9:
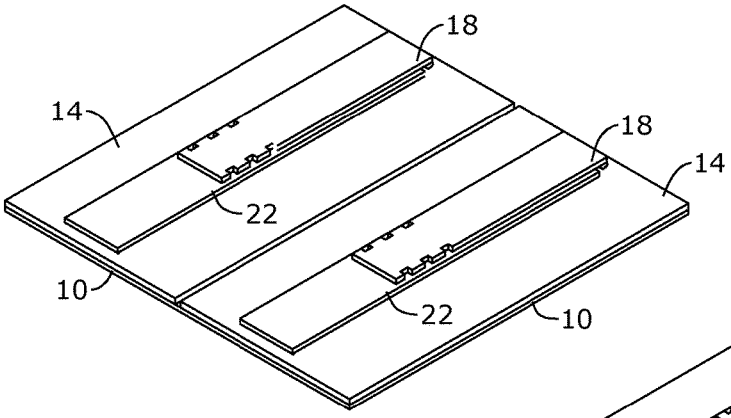
FIG. 9 is a perspective view of an embodiment of the present invention in the folded position.
Figure 10:
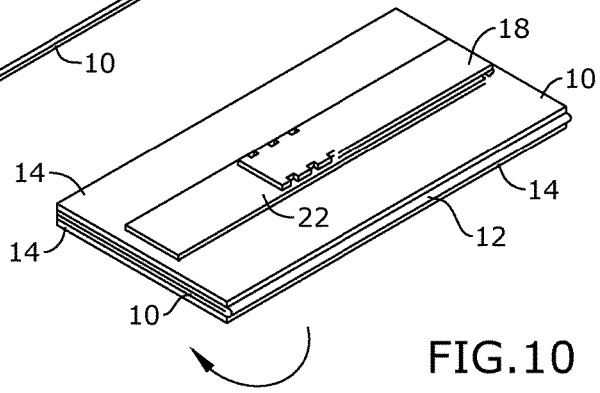
FIG. 10 is a perspective view of an embodiment of the present invention in the folded position.

As illustrated in FIG. 3, the present invention may include two stands 18, 22. In such embodiments a first stand 18, 22 is pivotally secured to the first rigid plate 14 and the second stand 18, 22 is pivotally secured to the second rigid plate 14. The two stands 18, 22 may add additional support to the quilt support when two rigid plates 14 are used.

In use, a quilter 28 may deploy the quilt support from the folded position to the deployed position. The user may fold the center strap 12 such that the gripping layer 10 is flat. The first arms 18 and the second arms 22 may be pivoted and connected together and may rest on a surface. The quilter 28 may then lay panels of quilting fabric 26 onto the gripping layer 10 and sew the panels together.

It should be understood, of course, that the foregoing relates to exemplary embodiments of the invention and that modifications may be made without departing from the spirit and scope of the invention as set forth in the following claims.

What is claimed is:

1. A quilt support comprising:

a first plate and a second plate hinged together by a center strap, wherein the first plate and the second plate each comprise a front surface and a rear surface;

a fabric layer for supporting a plurality of quilting fabric panels thereon, wherein the fabric layer is attached to and covers a substantial portion of the front surface of the first plate and the second plate; and a foldable stand pivotally attached to the rear surface of at least one of the first plate and the second plate, wherein the foldable stand comprises a folded position wherein the foldable stand is pivoted towards the rear surface and a deployed position wherein the foldable stand is pivoted away from the rear surface, wherein the foldable stand is operable to support the first plate and the second plate in an upright position when resting on a surface such that the first plate and the second plate are is disposed at an angle relative to the surface.

2. The quilt support of claim 1, wherein the fabric material is at least one of a felt material and a flannel material.

3. The quilt support of claim 1, wherein the stand comprises a first leg pivotally attached to a top end of the rear surface, and a second leg pivotally attached to a bottom end of the rear surface, wherein the first leg releasably secures to the second leg in the deployed position.

4. The quilt support of claim 3, wherein the first leg comprises a slot and the second leg comprises a plurality of notches, where the plurality of notches are releasably secured within the slot at different lengths of the second leg.

5. The quilt support of claim 1, wherein the first plate and the second plate each comprise a stand.

6. The quilt support of claim 1, wherein the folded position comprises the first plate and the second plate folded together, and the deployed position comprises the first plate and the second plate folded away from each other.

7. A quilt support comprising:

a first plate and a second plate hinged together by a center strap, wherein the first plate and the second plate each comprise a front surface and a rear surface;

a gripping layer attached to the front surface of the first plate and the second plate; and a foldable stand pivotally attached to the rear surface of at least one of the first plate and the second plate, wherein the foldable stand comprises a folded position wherein the foldable stand is pivoted towards the rear surface and a deployed position wherein the foldable stand is pivoted away from the rear surface, the foldable stand is operable to support the first plate and the second plate in an upright position when resting on a surface such that the first plate and the second plate are disposed at an angle relative to the surface.

8. A quilt support comprising:

at least one rigid plate comprising a front surface and a rear surface;

a gripping layer attached to the front surface of the rigid plate; and a foldable stand comprising a first leg pivotally attached to a top end of the rear surface, and a second leg pivotally attached to a bottom end of the rear surface, wherein the first leg comprises a slot comprising a wide portion and a narrow portion and the second leg comprises a plurality of notches, where the plurality of notches are releasably secured within the slot at different lengths of the second leg, wherein the foldable stand is operable to support the rigid plate in an upright position when resting on a surface such that the rigid plate is disposed at an angle relative to the surface.

* * * * *